US008282415B1

(12) United States Patent
Foltz et al.

(10) Patent No.: US 8,282,415 B1
(45) Date of Patent: Oct. 9, 2012

(54) MULTI-PORT CONNECTOR ASSEMBLY

(75) Inventors: Keith R. Foltz, Duncannon, PA (US); Francis J. Blasick, Halifax, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/091,981

(22) Filed: Apr. 21, 2011

(51) Int. Cl.
*H01R 9/05* (2006.01)

(52) U.S. Cl. ..... 439/579

(58) Field of Classification Search ..... 439/579, 439/541.5, 540.1, 63, 78, 80, 680, 906, 581, 439/752.5, 79, 246, 248
See application file for complete search history.

(56) References Cited

U.S. PATENT DOCUMENTS

| | | | | |
|---|---|---|---|---|
| 5,169,343 | A * | 12/1992 | Andrews | 439/607.11 |
| 6,832,932 | B1 | 12/2004 | Moseley | |
| 7,938,678 | B1 * | 5/2011 | Lee et al. | 439/541.5 |
| 2007/0249222 | A1 * | 10/2007 | Skluzacek et al. | 439/541.5 |
| 2008/0214045 | A1 * | 9/2008 | Tu et al. | 439/540.1 |

* cited by examiner

*Primary Examiner* — Edwin A. Leon
*Assistant Examiner* — Harshad Patel

(57) ABSTRACT

A multi-port connector assembly includes a housing that has a front end and a back end. The housing has a plurality of openings therethrough that extend between the front end and the back end. The housing has a shelf that extends from the back end. The shelf has a plurality of channels formed therein. A plurality of contact subassemblies are received in corresponding openings. The contact subassemblies have center conductors and outer shells surrounding the center conductors. The outer shells have rails that extend outward therefrom. The rails are received in corresponding channels to orient the contact subassemblies with respect to the housing.

20 Claims, 4 Drawing Sheets

MULTI-PORT CONNECTOR ASSEMBLY

BACKGROUND OF THE INVENTION

The subject matter herein relates generally to multi-port connector assemblies.

Due to their favorable electrical characteristics, coaxial cables and connectors have grown in popularity for interconnecting electronic devices and peripheral systems. The coaxial connectors include an inner conductor coaxially disposed within an outer conductor, with a dielectric material separating the inner and outer conductors. A typical application utilizing coaxial connectors is a radio-frequency (RF) application.

Typically, one or more coaxial connectors are mounted to a circuit board of an electronic device, such as at an input/output port of the device or alternatively, internal to the device. Some systems include a plurality of coaxial connectors held in a common housing. One particular example of a system that uses multiple coaxial connectors is a backplane module having a plurality of board mounted coaxial connectors with a separate mating assembly for mating with a daughtercard module.

However, known coaxial connectors are not without disadvantages. For instance, the coaxial connectors typically have a cylindrical shape, and are thus susceptible to rotating within the housing. Some systems utilize right angle connectors that extend from a circuit board and travel along a right angle path. Rotation of the right angle connectors is problematic because the coaxial connectors need to be positioned at precise locations for mounting to the board. Such alignment problems are exaggerated when multiple coaxial connectors need to be simultaneously mounted to the circuit board. When the mounting pins of the coaxial connectors are misaligned because the coaxial connector has rotated within the housing, mounting to the circuit board is difficult. Misalignment may cause damage to the mounting pins, the coaxial connectors and/or the circuit board.

A need thus exists for coaxial connectors that may be oriented with respect to the housing for mounting to a circuit board. A need also exists for coaxial connectors that have mounting pins that are less prone to buckling when the coaxial connectors are mounted to circuit boards.

BRIEF DESCRIPTION OF THE INVENTION

In one embodiment, a multi-port connector assembly is provided having a housing that has a front end and a back end. The housing has a plurality of openings therethrough that extend between the front end and the back end. The housing has a shelf that extends from the back end. The shelf has a plurality of housing anti-rotation features formed thereon. A plurality of contact subassemblies are received in corresponding openings. The contact subassemblies have center conductors and outer shells surrounding the center conductors. The outer shells have anti-rotation features formed thereon. The anti-rotation features interact with corresponding housing anti-rotation features to orient the contact subassemblies with respect to the housing.

In another embodiment, a multi-port connector assembly is provided having a housing that has a front end and a back end. The housing has a top end and a bottom end. The housing has a plurality of upper openings proximate to the top end that extends between the front end and the back end. The housing has a plurality of lower openings proximate to the bottom end that extends between the front end and the back end. The housing has a shelf that extends from the back end. The shelf has a top surface and a bottom surface. The shelf has a plurality of upper housing anti-rotation features formed in the top surface and a plurality of lower housing anti-rotation features formed in the bottom surface. A plurality of upper contact subassemblies are received in corresponding upper openings. The upper contact subassemblies have center conductors and outer shells surrounding the center conductors. The outer shells have anti-rotation features formed thereon. The anti-rotation features are received in corresponding upper housing anti-rotation features to orient the contact subassemblies with respect to the housing. A plurality of lower contact subassemblies are received in corresponding lower openings. The lower contact subassemblies have center conductors and outer shells surrounding the center conductors. The outer shells have anti-rotation features formed thereon. The anti-rotation features are received in corresponding lower housing anti-rotation features to orient the contact subassemblies with respect to the housing.

In a further embodiment, a multi-port connector system is provided having a plug connector assembly and a receptacle connector assembly. The plug connector assembly has a header housing that has a front end and a back end. The header housing has a plurality of openings therethrough extending between the front end and the back end. The header housing has a shelf that extends from the back end. The shelf has a plurality of channels formed therein. The plug connector assembly also includes a plurality of plug contact subassemblies received in corresponding openings of the header housing. The plug contact subassemblies have center conductors and outer shells surrounding the center conductors. The outer shells have rails that extend outward therefrom. The rails are received in corresponding channels of the header housing to orient the plug contact subassemblies with respect to the housing. The receptacle connector assembly includes a receptacle housing that has a front end and a back end. The receptacle housing has a plurality of openings therethrough that extend between the front end and the back end. The receptacle housing has a shelf that extends from the back end. The shelf has a plurality of channels formed therein. The receptacle connector assembly also includes a plurality of receptacle contact subassemblies received in corresponding openings of the receptacle housing. The receptacle contact subassemblies have center conductors and outer shells surrounding the center conductors. The outer shells have rails that extend outward therefrom. The rails are received in corresponding channels of the receptacle housing to orient the receptacle contact subassemblies with respect to the housing. The plug connector assembly is mated to the receptacle connector assembly to mate the plug contact subassemblies with the receptacle contact subassemblies.

DETAILED DESCRIPTION OF THE INVENTION

Figure 1:
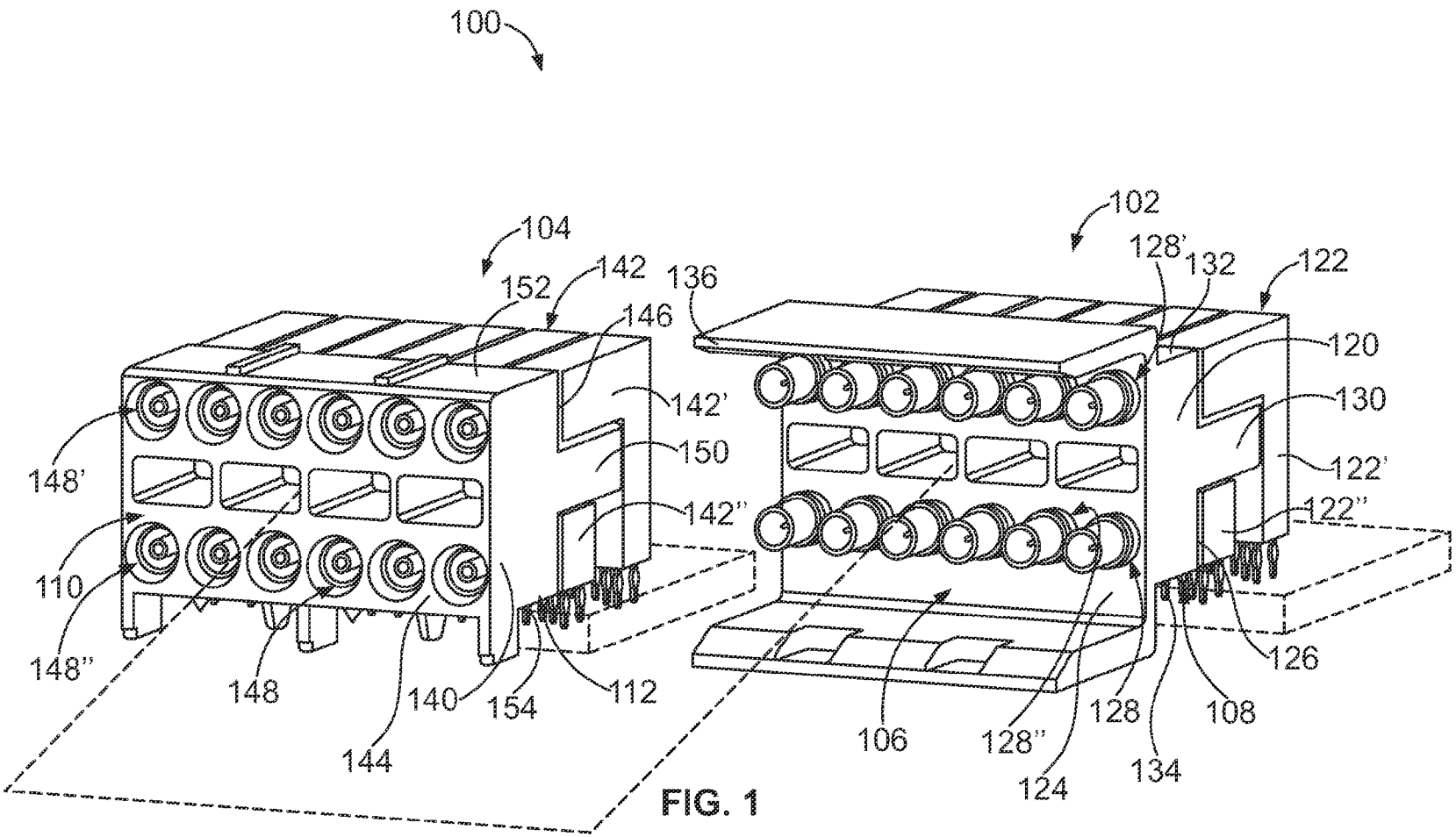
FIG. 1 is a perspective view of a multi-port connector system formed in accordance with one embodiment.

FIG. 1 is a perspective view of a multi-port connector system 100 formed in accordance with one embodiment. The system 100 shown in FIG. 1 is a right angle connector system. The system 100 includes a plug connector assembly 102 and a receptacle connector assembly 104. The plug connector assembly 102 mates with the receptacle connector assembly 104 to electrically couple the plug connector assembly 102 with the receptacle connector assembly 104. The plug connector assembly 102 and receptacle connector assembly 104 define multi-port connector assemblies having a plurality of individual contact subassemblies that are simultaneously mated at a separable interface. In an exemplary embodiment, the plug connector assembly 102 and receptacle connector assembly 104 utilize coaxial contact subassemblies, such as those typically utilized in RF applications.

In the illustrated embodiment, the plug connector assembly 102 and the receptacle connector assembly 104 are right angle connectors. For example, the plug connector assembly 102 may have a mating interface 106 and a mounting interface 108 that are oriented substantially perpendicular with respect to one another. Similarly, the receptacle connector assembly 104 may have a mating interface 110 and a mounting interface 112 that are oriented substantially perpendicular with respect to one another. The mating interfaces 106, 110 engage one another when the plug connector assembly 102 and receptacle connector assembly 104 mate with each other.

The mounting interfaces 108, 112 are configured to engage separate circuit boards (shown in phantom in FIG. 1) such that the system 100 electronically joins the separate circuit boards through the plug connector assembly 102 and the receptacle connector assembly 104. The circuit boards to which the plug connector assembly 102 and the receptacle connector assembly 104 are mounted may be oriented approximately parallel or coplanar with respect to one another when the plug connector assembly 102 mates with the receptacle connector assembly 104. Alternatively, the plug connector assembly 102 and/or the receptacle connector assembly 104 may be cable mounted to individual coaxial cables.

The plug connector assembly 102 includes a header housing 120 that holds a plurality of plug contact subassemblies 122. The header housing 120 extends between a front end 124 and a back end 126. The header housing 120 has a plurality of openings 128 therethrough extending between the front and back ends 124, 126. The header housing 120 includes a shelf 130 extending rearward from the back end 126. In the illustrated embodiment, the shelf 130 is substantially centered between a top end 132 and a bottom end 134 of the header housing 120. The bottom end 134 is configured to be mounted to the circuit board. The plug contact subassemblies 122 are coupled to the header housing 120 such that portions of the plug contact subassemblies 122 extend through corresponding openings 128. In an exemplary embodiment, the plug contact subassemblies 122 are loaded into the openings 128 through the back end 126. Portions of the plug contact subassemblies 122 are exposed at the front end 124 for mating with the receptacle connector assembly 104. In an exemplary embodiment, the header housing 120 includes a hood 136 extending forward from the front end 124 at both the top end 132 and the bottom end 134. The receptacle connector assembly 104 is configured to be received within the hood 136 for mating with the plug contact subassemblies 122.

In an exemplary embodiment, the openings 128 are arranged in an upper row and a lower row, with a plurality of upper openings 128' proximate to the top end 132 and a plurality of lower openings 128" proximate to the bottom end 134. The shelf 130 is positioned between the upper openings 128' and the lower openings 128". The plug contact subassemblies 122 are received in corresponding openings 128. In an exemplary embodiment, the plug connector assembly 102 includes a plurality of upper plug contact subassemblies 122' received in the upper openings 128' above the shelf 130. The plug connector assembly 102 also includes a plurality of lower plug contact subassemblies 122" received in corresponding lower openings 128" below the shelf 130. The upper and lower plug contact subassemblies 122', 122" are sized and shaped differently than one another.

The receptacle connector assembly 104 includes a receptacle housing 140 that holds a plurality of receptacle contact subassemblies 142. The receptacle housing 140 extends between a front end 144 and a back end 146. The receptacle housing 140 has a plurality of openings 148 therethrough extending between the front and back ends 144, 146. The receptacle housing 140 includes a shelf 150 extending rearward from the back end 146. In the illustrated embodiment, the shelf 150 is substantially centered between a top end 152 and a bottom end 154 of the receptacle housing 140. The bottom end 154 is configured to be mounted to the circuit board. The receptacle contact subassemblies 142 are coupled to the receptacle housing 140 such that portions of the receptacle contact subassemblies 142 extend through corresponding openings 148. In an exemplary embodiment, the receptacle contact subassemblies 142 are loaded into the openings 148 through the back end 146. Portions of the receptacle contact subassemblies 142 are exposed at the front end 144 for mating with the plug connector assembly 102.

In an exemplary embodiment, the openings 148 are arranged in an upper row and a lower row, with a plurality of upper openings 148' proximate to the top end 152 and a plurality of lower openings 148" proximate to the bottom end 154. The shelf 150 is positioned between the upper openings 148' and the lower openings 148". The receptacle contact subassemblies 142 are received in corresponding openings 148. In an exemplary embodiment, the receptacle connector assembly 102 includes a plurality of upper receptacle contact subassemblies 142' received in the upper openings 148' above the shelf 150. The receptacle connector assembly 102 also includes a plurality of lower receptacle contact subassemblies 142" received in corresponding lower openings 148" below the shelf 150. The upper and lower receptacle contact subassemblies 142', 142" are sized and shaped differently than one another.

Figure 2:
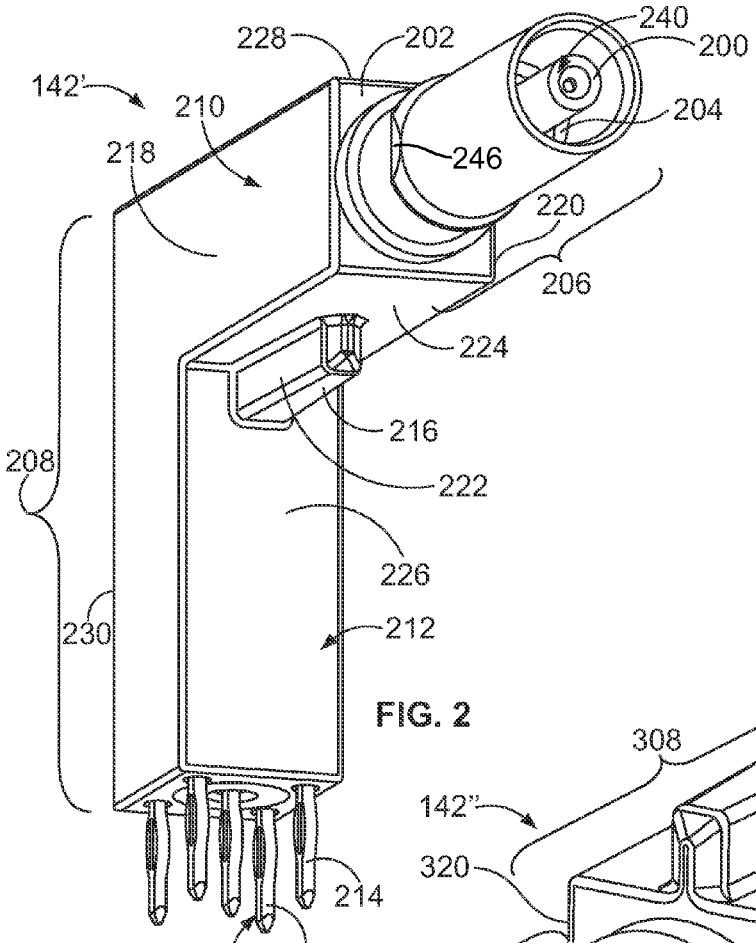
FIG. 2 is a front perspective view of a receptacle contact subassembly formed in accordance with an exemplary embodiment.

FIG. 2 is a front perspective view of one of the upper receptacle contact subassemblies 142' formed in accordance with an exemplary embodiment. The contact subassembly 142' is a coaxial connector. The contact subassembly 142' is configured to be board mounted to a circuit board. Alternatively, the contact subassembly 142' may be cable mounted. The contact subassembly 142' includes a center conductor 200 and an outer shell 202 surrounding the center conductor 200. The center conductor 200 is separated from the outer shell 202 by one or more insulators 204. In the illustrated embodiment, the contact subassembly 142' is a right angle connector wherein the center conductor 200 extends along a right angle path.

The outer shell 202 circumferentially surrounds the center conductor 200. The outer shell 202 is fabricated from a conductive material, such as a metal material. The outer shell 202 provides shielding around the center conductor 200, such as to provide shielding from electromagnetic interference (EMI).

The outer shell 202 includes a mating portion 206 and a mounting portion 208. The mating portion 206 is configured to be received in a corresponding opening 148' (shown in FIG. 1). In the illustrated embodiment, the mating portion 206 has a generally cylindrical shape.

The mounting portion 208 is configured to be coupled to the shelf 150 (shown in FIG. 1). The mounting portion 208 is configured to be mounted to a circuit board. The mounting portion 208 is generally box-shaped around the center conductor 200, however the mounting portion 208 may have other shapes in alternative embodiments. The mounting portion 208 includes a horizontal section 210 and a vertical section 212. The mating portion 206 extends forward from the horizontal section 210 of the mounting portion 208. In an exemplary embodiment, a plurality of grounding pins 214 extends downward from the bottom of the vertical section 212. The grounding pins 214 are electrically coupled to the outer shell 202. Optionally, the grounding pins 214 may be integrally formed with the outer shell 202. The grounding pins 214 are configured to be terminated to the circuit board, such as by being press-fit into ground through-holes of the circuit board.

The outer shell 202 includes an anti-rotation feature 216 extending outward therefrom. In the illustrated embodiment, the anti-rotation feature 216 is a rail, and may be referred to hereinafter as rail 216. Other types of anti-rotation features may be used in alternative embodiments, such as a channel, a tongue, a groove, a peg, a pin, an opening, a latch or another anti-rotation feature that interacts with the plug connector assembly 102 or header connector assembly 104 to orient the outer shell 202. In an exemplary embodiment, the rail 216 is provided at the intersection between the horizontal section 210 and the vertical section 212. The rail 216 extends downward from the horizontal section 210. The rail 216 extends forward from the vertical section 212. The rail 216 is thinner than the outer shell 202. Optionally, the rail 216 may be substantially centered between opposite sides 218, 220 of the outer shell 202. The rail 216 is defined by rail walls 222. Optionally, the rail walls 222 may be beveled such that the rail 216 is thinner at a front end of the rail 216 than at a back end of the rail 216. Optionally, portions of the rail walls 222 may be parallel to one another. The rail 216 extends downward from a bottom surface 224 of the horizontal section 210. The rail 216 extends forward from a front surface 226 of the vertical section 212. The bottom surface 224 is generally opposite to a top surface 228. The front surface 226 is generally opposite to a back surface 230.

The center conductor 200 extends between a mating end 240 and a mounting end 242. The mating end 240 is generally positioned within the mating portion 206 of the outer shell 202. The mounting end 242 extends from the mounting portion 208 of the outer shell 202. The center conductor 200 extends along a right angle path within the outer shell 202 with the center conductor 200 extending along the horizontal section 210 and the vertical section 212. In the illustrated embodiment, the mating end 240 defines a socket configured to receive a pin of the plug connector assembly 102 (shown in FIG. 1). Other types of contacts may be provided in alternative embodiments of the mating end 240. In the illustrated embodiment, the mounting end 242 includes a compliant pin 244 that is configured to be press fit in a plated through-hole of the circuit board. The grounding pins 214 surround the compliant pin 244.

The compliant pin 244 and grounding pins 214 have a predetermined pin-out for mating with the circuit board. The contact subassembly 142'needs to properly align with the circuit board such that the pins 244, 214 are aligned with the corresponding through-holes in the circuit board. Misalignment between the compliant pin 244 and/or grounding pins 214 may cause damage to such pins 244, 214 during mounting of the contact subassembly 142' to the circuit board. As described in further detail below, the rail 216 is used to align the contact subassembly 142' with respect to the receptacle housing 140 (shown in FIG. 1) to properly align the pins 244, 214 with the corresponding through-holes in the circuit board. The rail 216 holds the true position of the pins 244, 214 for mounting to the circuit board.

In an exemplary embodiment, the mating portion 206 includes an anti-rotation feature 246. In the illustrated embodiment, the anti-rotation feature 246 is represented by a flat on the flange extending around the mating portion 206, and may be referred to hereinafter as flat 246. The flat 246 is configured to engage a portion of the opening 128 or 148 (shown in FIG. 1) to orient the contact assembly 142' within such opening 128 or 148.

Figure 3:
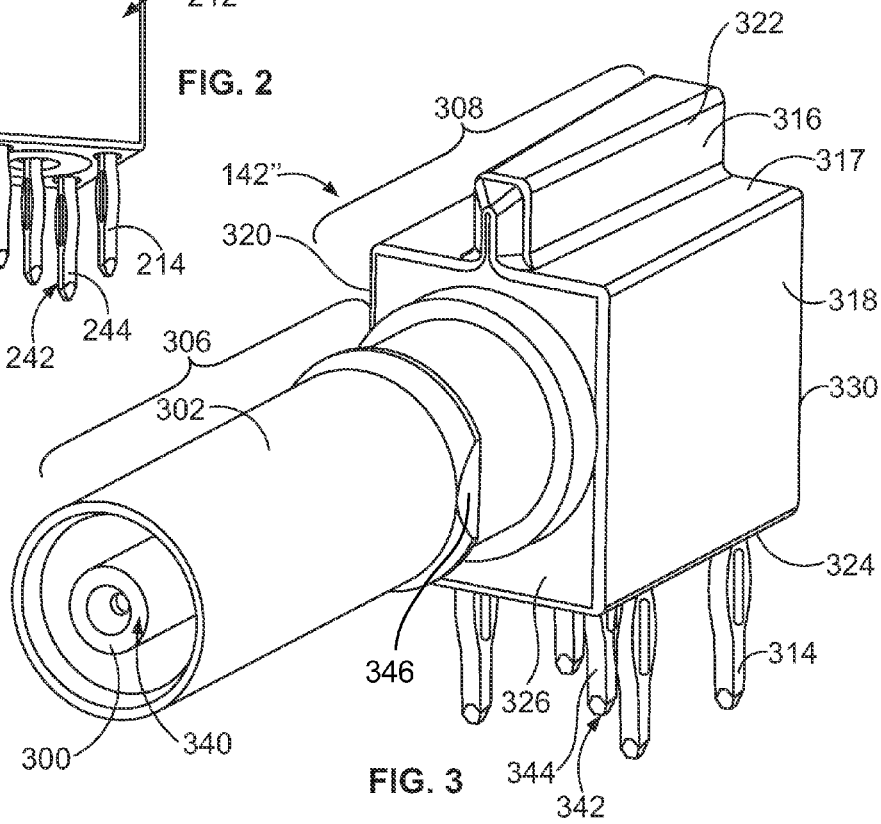
FIG. 3 is front perspective view of another receptacle contact subassembly.

FIG. 3 is front perspective view of one of the lower receptacle contact subassemblies 142" formed in accordance with an exemplary embodiment. The contact subassembly 142" is a coaxial connector. The contact subassembly 142" is configured to be board mounted to a circuit board. Alternatively, the contact subassembly 142" may be cable mounted. The contact subassembly 142" includes a center conductor 300 and an outer shell 302 surrounding the center conductor 300. The center conductor 300 is isolated from the outer shell 302 by one or more insulators (not shown). In the illustrated embodiment, the contact subassembly 142" is a right angle connector wherein the center conductor 300 extends along a right angle path.

The outer shell 302 circumferentially surrounds the center conductor 300. The outer shell 302 is fabricated from a conductive material, such as a metal material. The outer shell 302 provides shielding around the center conductor 300, such as to provide shielding from electromagnetic interference (EMI).

The outer shell 302 includes a mating portion 306 and a mounting portion 308. The mating portion 306 is configured to be received in a corresponding opening 148" (shown in FIG. 1). In the illustrated embodiment, the mating portion 306 has a generally cylindrical shape.

The mounting portion 308 is configured to be coupled to the shelf 150 (shown in FIG. 1). The mounting portion 308 is configured to be mounted to a circuit board. In the illustrated embodiment, the mounting portion 308 is generally box-shaped around the center conductor 300, however the mounting portion 308 may have other shapes in alternative embodiments. The mating portion 306 extends forward from the mounting portion 308. In an exemplary embodiment, a plurality of grounding pins 314 extends downward from the bottom of the mounting portion 308. The grounding pins 314 are electrically coupled to the outer shell 302. Optionally, the grounding pins 314 may be integrally formed with the outer shell 302. The grounding pins 314 are configured to be terminated to the circuit board, such as by being press-fit into ground through-holes of the circuit board.

The outer shell 302 includes an anti-rotation feature 316 extending outward therefrom. In the illustrated embodiment, the anti-rotation feature 316 constitutes a rail, and may be referred to hereinafter as rail 316. Other types of anti-rotation features may be used in alternative embodiments. In an exemplary embodiment, the rail 316 is provided along a top surface 317 of the mounting portion 308. The rail 316 extends upward from the mounting portion 308. The rail 316 is thinner than the outer shell 302. Optionally, the rail 316 may be substantially centered between opposite sides 318, 320 of the outer shell 302. The rail 316 is defined by rail walls 322. Optionally, the rail walls 322 may be beveled such that the rail 316 is thinner at a front end of the rail 316 than at a back end of the rail 316. Optionally, portions of the rail walls 322 may be parallel to one another. The top surface 317 is generally opposite to a bottom surface 324. The mounting portion 308 also includes a front surface 326 and a back surface 330.

The center conductor 300 extends between a mating end 340 and a mounting end 342. The mating end 340 is generally positioned within the mating portion 306 of the outer shell 302. The mounting end 342 extends from the mounting portion 308 of the outer shell 302. The center conductor 300 extends along a right angle path within the outer shell 302 with the center conductor 300 making a right angle within the mounting portion 308. In the illustrated embodiment, the mating end 340 defines a socket configured to receive a pin of the plug connector assembly 102 (shown in FIG. 1). Other types of contacts may be provided in alternative embodiments of the mating end 340. In the illustrated embodiment, the mounting end 342 includes a compliant pin 344 that is configured to be press fit in a plated through-hole of the circuit board. The grounding pins 314 surround the compliant pin 344.

The compliant pin 344 and grounding pins 314 have a predetermined pin-out for mating with the circuit board. The contact subassembly 142" needs to properly align with the circuit board such that the pins 344, 314 are aligned with the corresponding through-holes in the circuit board. Misalignment between the compliant pin 344 and/or grounding pins 314 may cause damage to such pins 344, 314 during mounting of the contact subassembly 142" to the circuit board. As described in further detail below, the rail 316 is used to align the contact subassembly 142" with respect to the receptacle housing 140 (shown in FIG. 1) to properly align the pins 344, 314 with the corresponding through-holes in the circuit board. The rail 316 holds the true position of the pins 344, 314 for mounting to the circuit board.

In an exemplary embodiment, the mating portion 306 includes an anti-rotation feature 346. In the illustrated embodiment, the anti-rotation feature 346 is represented by a flat on the flange extending around the mating portion 306, and may be referred to hereinafter as flat 346. The flat 346 is configured to engage a portion of the opening 128 or 148 (shown in FIG. 1) to orient the contact assembly 142" within such opening 128 or 148.

Figure 4:
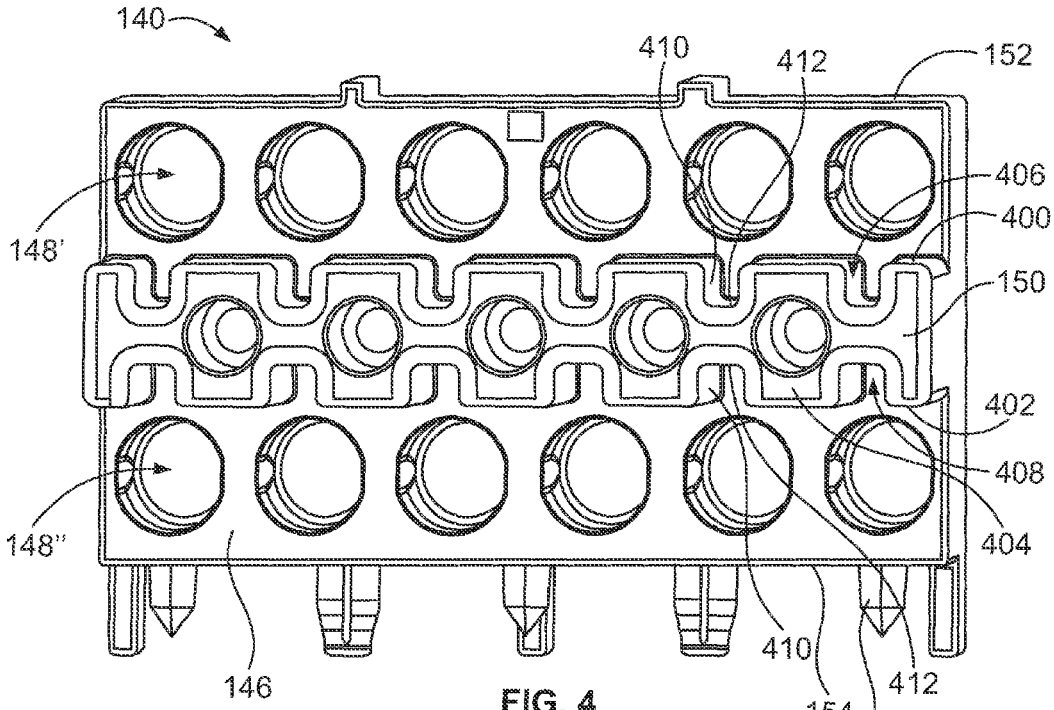
FIG. 4 is a rear perspective view of the receptacle housing.

FIG. 4 is a rear perspective view of the receptacle housing 140. The shelf 150 extends rearward from the back end 146 of the receptacle housing 140. The shelf 150 has a top surface 400 and a bottom surface 402. The top and bottom surfaces 400, 402 are generally parallel to, and spaced apart from, the top end 152 and the bottom end 154, respectively, of the receptacle housing 140. The shelf 150 is positioned between the upper row of openings 148' and the lower row of openings 148". The shelf 150 extends outward from the back end 146 to a back edge 404.

The shelf 150 includes a plurality of upper housing anti-rotation features 406 in the top surface 400. The shelf 150 includes a plurality of lower housing anti-rotation features 408 in the bottom surface 402. In the illustrated embodiment, the housing anti-rotation features 406, 408 constitute channels, and may be referred to hereinafter as channels 406, 408. Other types of housing anti-rotation features may be used in alternative embodiments, such as a rail, a tongue, a groove, a peg, a pin, an opening, a latch or another type of anti-rotation feature that interacts with the contact subassemblies 142', 142" (shown in FIGS. 2 and 3, respectively). The channels 406, 408 are configured to receive alignment members, such as the complementary anti-rotation features, of the receptacle contact subassemblies 142', 142" therein. For example, the channels 406 receive the rails 216 of the upper receptacle contact subassemblies 142'. The channels 408 receive the rails 316 of the lower receptacle contact subassemblies 142".

The channels 406, 408 are defined by side walls 410. The channels 406, 408 have inner walls 412 generally opposite the open end of the channels 406, 408. The channels 406, 408 are open at the back edge 404 and extend toward the back end 146 of the receptacle housing 140. Optionally, the channels 406, 408 may extend entirely between the back edge 404 and the back end 146 such that the back end 146 is exposed in the channels 406, 408.

The side walls 410 may be beveled or tapered such that the channels 406, 408 are narrower at the fronts of the channels 406, 408 and are wider at the backs of the channels 406, 408. The size and shape of the channels 406, 408 correspond with the size and the shape of the rails 216, 316 such that the channels 406, 408 are able to receive the rails 216, 316. Optionally, the upper channels 406 may be sized differently than the lower channels 408 to define keying features to receive corresponding rails 216, 316, respectively.

The upper channels 406 are generally aligned with the upper openings 148' wherein each upper opening 148' is associated with a corresponding upper channel 406. The lower channels 408 are generally aligned with the lower openings 148" wherein each lower opening 148" is associated with a corresponding lower channel 408.

The receptacle housing 140 includes a plurality of posts 420 extending downward from the bottom end 154. The posts 420 are configured to be received in alignment openings in the circuit board to position the receptacle housing 140 with respect to the circuit board.

Figure 5:
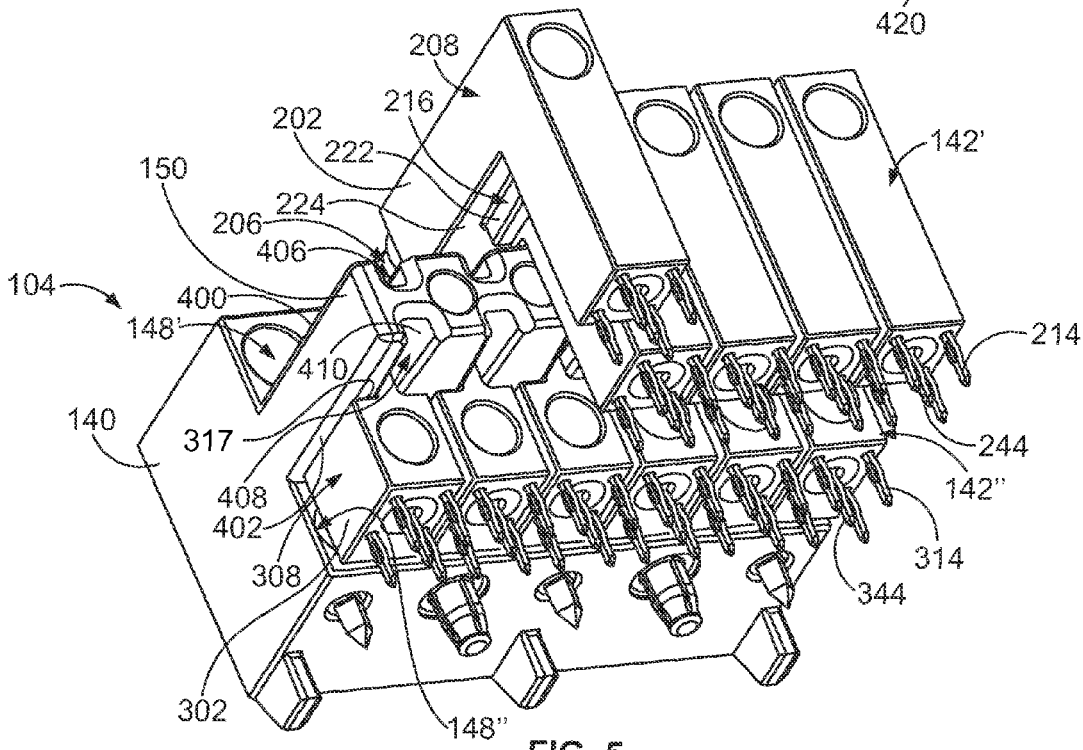
FIG. 5 is a rear perspective view of the receptacle connector assembly.

FIG. 5 is a rear perspective view of the receptacle connector assembly 104. The receptacle contact subassemblies 142', 142" are loaded into the receptacle housing 140. In an exemplary embodiment, the lower receptacle contact subassemblies 142" are loaded into the receptacle housing 140 prior to the upper receptacle contact subassemblies 142" being loaded into the receptacle housing 140.

The lower receptacle contact subassemblies 142" are loaded into the receptacle housing 140 such that the mating portions 306 (shown in FIG. 3) are loaded into the lower openings 148" (shown in FIG. 1). The mounting portions 308 are coupled to the receptacle housing 140. For example, the rails 316 are loaded into the lower channels 408. The rail walls 322 engage the side walls 410 of the lower channels 408. The engagement between the rail walls 322 and the side walls 410 holds the position of the lower receptacle contact subassemblies 142" with respect to the receptacle housing 140.

The rails 316 function as anti-rotation features to resist twisting or rotation of the outer shell 302 within the receptacle housing 140. The rails 316 hold the angular position of the receptacle contact subassemblies 142". The rails 316 also align the mounting portion 308 with respect to the receptacle housing 140 to position the compliant pins 344 and/or grounding pins 314 for mounting to the circuit board. The engagement between the rails 316 and the channels 408 ensures that the pins 344, 314 are properly positioned for loading into the through-holes in the circuit board.

The rails 316 are held in the lower channels 408 by a tight tolerance such that the receptacle contact subassemblies 142"

do not move side-to-side within the lower channels 408. The bevel on the lower channels 408 and the bevel on the rails 316 causes greater interference as the contact subassemblies 142" are loaded into the receptacle housing 140. In an exemplary embodiment, the top surface 317 of the outer shell 302 engages the bottom surface 402 of the shelf 150. The interference between the top surface 317 and the bottom surface 402 prevents rotation of the receptacle contact subassemblies 142" with respect to the receptacle housing 140.

After the lower receptacle contact subassemblies 142" are loaded into the housing 140, the upper receptacle contact subassemblies 142' may be loaded into the housing 140. The upper receptacle contact subassemblies 142' are loaded into the receptacle housing 140 such that the mating portions 206 are loaded into the upper openings 148'. The mounting portions 208 are coupled to the receptacle housing 140. For example, the rails 216 are loaded into the upper channels 406. The rail walls 222 engage the side walls 410 of the upper channels 406. The engagement between the rail walls 222 and the side walls 410 holds the position of the upper receptacle contact subassemblies 142' with respect to the receptacle housing 140.

The rails 216 function as anti-rotation features to resist twisting or rotation of the outer shell 202 within the receptacle housing 140. The rails 216 hold the angular position of the upper receptacle contact subassemblies 142'. The rails 216 also align the mounting portion 208 with respect to the receptacle housing 140 to position the compliant pins 244 and/or grounding pins 214 for mounting to the circuit board. The engagement between the rails 216 and the channels 406 ensures that the pins 244, 214 are properly positioned for loading into the through-holes in the circuit board.

The rails 216 are held in the upper channels 406 by a tight tolerance such that the upper receptacle contact subassemblies 142' do not move side to side within the upper channels 406. The bevel on the upper channels 406 and the bevel on the rails 216 causes greater interference as the contact subassemblies 142' are loaded into the receptacle housing 140. In an exemplary embodiment, the bottom surface 224 of the outer shell 202 engages the top surface 400 of the shelf 150. The interference between the bottom surface 224 and the top surface 400 prevents rotation of the upper receptacle contact subassemblies 142' with respect to the receptacle housing 140.

In an alternative embodiment, the contact subassemblies 142', 142" may include different types of anti-rotation features 216, 316 and the shelf 150 may include different types of housing anti-rotation features 406, 408. For example, the contact sub-assemblies 142', 142" may include channels and the shelf 150 may include rails. Other types of anti-rotation features may be used in other embodiments.

Figure 6:
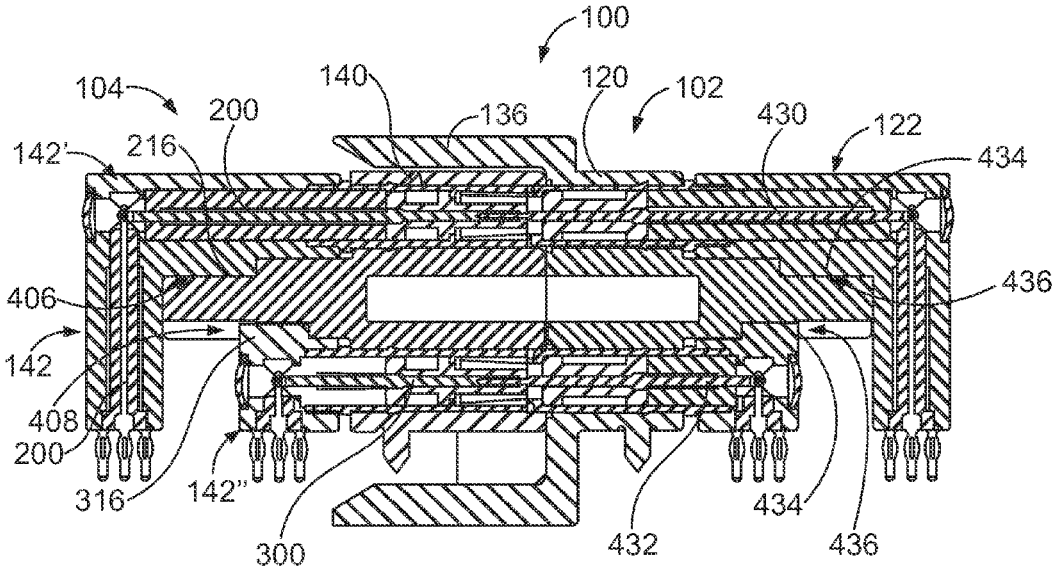
FIG. 6 is a cross-sectional view of the connector system showing a plug connector assembly mated with a receptacle connector assembly.

FIG. 6 is a cross-sectional view of the connector system 100 showing the plug connector assembly 102 mated with the receptacle connector assemblies 104. The receptacle housing 140 is loaded into the receiving space defined by the hood 136 such that the receptacle contact subassemblies 142 are mated to the plug contact subassemblies 122. The center conductors 200, 300 are mated to corresponding center conductors 430, 432 of upper and lower plug contact subassemblies 122.

The rails 216, 316 are shown loaded into the upper channels 406 and lower channels 408, respectively, to orient the receptacle contact subassemblies 142', 142" with respect to the receptacle housing 140. FIG. 6 also illustrates rails 434 of the plug contact subassemblies 122 loaded into corresponding channels 436 in the header housing 120. The rails 434 operate in a similar manner as the rails 216, 316 to orient the plug contact subassemblies 122 with respect to the header housing 120. The rails 434 operate as anti-rotation features to control the angular position of the plug contact subassemblies 122 with respect to the header housing 120. The rails 434 help to align the center conductors 430, 432 for mounting to the circuit board (not shown).

Figure 7:
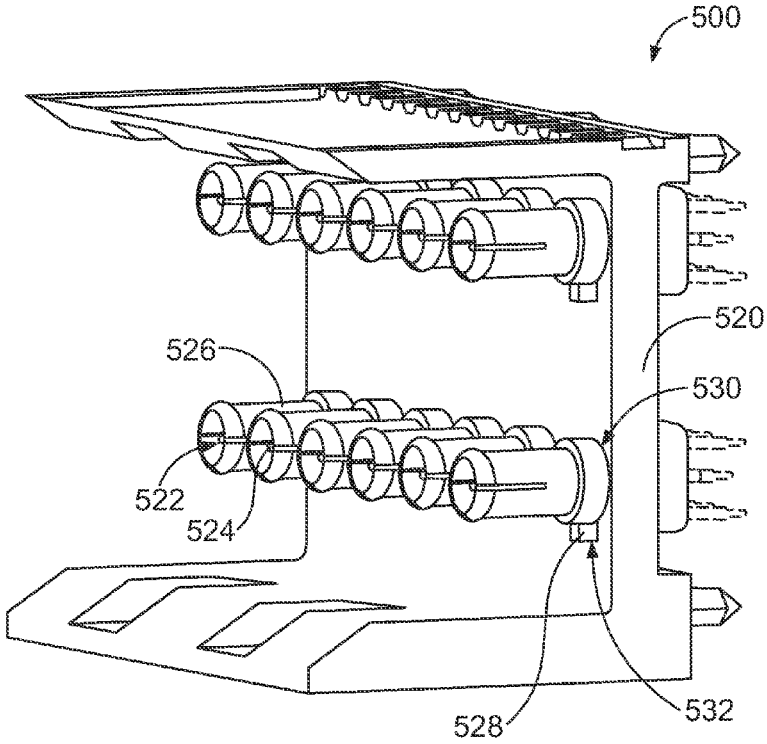
FIG. 7 is a front perspective view of an alternative plug connector assembly formed in accordance with an alternative embodiment.

FIG. 7 is a front perspective view of an alternative plug connector assembly 500 formed in accordance with an alternative embodiment. The plug connector assembly 500 includes a header housing 520 holding a plurality of plug contact subassemblies 522.

The plug contact subassemblies 522 are straight or vertical coaxial connectors, as opposed to right angle coaxial connectors. Each plug contact subassembly 522 includes a center conductor 524 that extends linearly. An outer shell 526 extends around the center conductor 524. The outer shell 526 includes a rail 528 extending therefrom. The outer shell 526 is received in an opening 530 of the header housing 520. A channel 532 extends downward from the opening 530. The rail 528 is received in the channel 532 to orient the plug contact subassembly 522 with respect to the header housing 520. The rail 528 functions as an anti-rotation feature of the plug contact subassemblies 522 to prevent rotation of the plug contact subassemblies 522 within the openings 530.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A multi-port connector assembly comprising:

a housing having a front end and a back end, the housing having a plurality of openings therethrough extending between the front end and the back end, the housing having a shelf extending from the back end, the shelf having a plurality of housing anti-rotation features formed thereon; and a plurality of contact subassemblies received in corresponding openings, the contact subassemblies having center conductors and outer shells surrounding the center conductors, the outer shells having anti-rotation features formed thereon, the anti-rotation features interacting with corresponding housing anti-rotation features to orient the contact subassemblies with respect to the housing, the anti-rotation features being held in the housing anti-rotation features by an interference fit.

2. The multi-port connector assembly of claim 1, wherein the housing anti-rotation features comprise channels including side walls, the anti-rotation features of the contact subassemblies comprise rails including rail walls engaging the side walls to prevent rotation of the contact subassemblies with respect to the housing.

3. The multi-port connector assembly of claim 1, wherein the center conductors extend along contact planes, the anti-rotation features engaging the housing anti-rotation features to orient the contact planes parallel to one another.

4. The multi-port connector assembly of claim 1, wherein each center conductor includes a mounting pin configured to be terminated to a circuit board, the outer shells having at least one grounding pin configured to be terminated to the circuit board, the anti-rotation features orienting the contact subassemblies to position the mounting pins and the grounding pins for pressing into the circuit board.

5. The multi-port connector assembly of claim 1, wherein each contact subassembly includes a mating interface and a mounting interface, the mating interface being configured to be coupled to a contact subassembly of a mating connector assembly, the mounting interface being configured to be terminated to a circuit board.

6. The multi-port connector assembly of claim 1, wherein the anti-rotation features comprise rails that are chamfered and the housing anti-rotation features comprise channels that are beveled to guide the rails into the channels.

7. The multi-port connector assembly of claim 1, wherein the contact subassemblies are right angle contact subassemblies, wherein the center conductors extend along right angle paths.

8. The multi-port connector assembly of claim 1, wherein the openings are arranged in an upper row and a lower row, the shelf being positioned between the openings in the upper row and the openings in the lower row, the shelf having the housing anti-rotation features along a top surface of the shelf and along a bottom surface of the shelf, the contact subassemblies being loaded into corresponding openings in the upper row and the lower row with the anti-rotation features engaging corresponding housing anti-rotation features.

9. The multi-port connector assembly of claim 1, wherein the housing anti-rotation features are aligned with the openings.

10. The multi-port connector assembly of claim 1, wherein the engagement between the anti-rotation features and the housing anti-rotation features holds the contact subassemblies at spaced apart positions from one another.

11. A multi-port connector assembly comprising:

a housing having a front end and a back end, the housing having a top end and a bottom end, the housing having a plurality of upper openings proximate to the top end extending between the front end and the back end, the housing having a plurality of lower openings proximate to the bottom end extending between the front end and the back end, the housing having a shelf integral with the housing and extending from the back end, the shelf having a top surface and a bottom surface, the shelf having a plurality of upper housing anti-rotation features formed in the top surface and a plurality of lower housing anti-rotation features formed in the bottom surface;

a plurality of upper contact subassemblies received in corresponding upper openings, the upper contact subassemblies having center conductors and outer shells surrounding the center conductors, the outer shells having anti-rotation features extending downward therefrom, the anti-rotation features interacting with corresponding upper housing anti-rotation features to orient the contact subassemblies with respect to the housing; and a plurality of lower contact subassemblies received in corresponding lower openings, the lower contact subassemblies having center conductors and outer shells surrounding the center conductors, the outer shells having anti-rotation features extending upward therefrom, the anti-rotation features interacting with corresponding lower housing anti-rotation features to orient the contact subassemblies with respect to the housing.

12. The multi-port connector assembly of claim 11, wherein the upper housing anti-rotation features and the lower housing anti-rotation features comprise channels including side walls, the anti-rotation features of the upper and lower contact subassemblies comprise rails including rail walls engaging corresponding side walls to prevent rotation of the corresponding contact subassembly with respect to the housing.

13. The multi-port connector assembly of claim 11, wherein the center conductors of the upper contact subassemblies extend along contact planes, the anti-rotation features engaging corresponding upper housing anti-rotation features such that the contact planes are parallel to one another.

14. The multi-port connector assembly of claim 11, wherein the anti-rotation features are held in corresponding upper or lower housing anti-rotation features by an interference fit.

15. The multi-port connector assembly of claim 11, wherein the anti-rotation features comprise rails that are chamfered and the upper and lower housing anti-rotation features comprise channels that are beveled to guide the rails into the corresponding channels.

16. The multi-port connector assembly of claim 11, wherein each center conductor includes a mounting pin configured to be terminated to a circuit board, each outer shell having at least one grounding pin configured to be terminated to the circuit board, the anti-rotation features of the upper contact subassemblies orienting the upper contact subassemblies to position the mounting pins and the grounding pins for pressing into the circuit board, the anti-rotation features of the lower contact subassemblies orienting the lower contact subassemblies to position the mounting pins and the grounding pins for pressing into the circuit board.

17. A multi-port connector system comprising:

a plug connector assembly comprising a header housing having a front end and a back end, the header housing having a plurality of openings therethrough extending between the front end and the back end, the header housing having a shelf extending from the back end, the shelf having a plurality of channels formed therein, the plug connector assembly comprising a plurality of plug contact subassemblies received in corresponding openings of the header housing, the plug contact subassemblies having center conductors and outer shells surrounding the center conductors, the outer shells having rails extending outward therefrom, the rails being received in corresponding channels of the header housing to orient the plug contact subassemblies with respect to the housing; and a receptacle connector assembly comprising a receptacle housing having a front end and a back end, the receptacle housing having a plurality of openings therethrough extending between the front end and the back end, the receptacle housing having a shelf extending from the back end, the shelf having a plurality of channels formed therein, the receptacle connector assembly comprising a plurality of receptacle contact subassemblies received in corresponding openings of the receptacle housing, the receptacle contact subassemblies having center conductors and outer shells surrounding the center conductors, the outer shells having rails extending outward therefrom, the rails being received in corresponding channels of the receptacle housing to orient the receptacle contact subassemblies with respect to the housing;

wherein the plug connector assembly is mated to the receptacle connector assembly to mate the plug contact subassemblies with the receptacle contact subassemblies; and wherein each center conductor includes a mounting pin configured to be terminated to a corresponding circuit board, the outer shells having at least one grounding pin configured to be terminated to the corresponding circuit board, the rails orienting the contact subassemblies to position the mounting pins and the grounding pins for pressing into the circuit board.

18. The multi-port connector system of claim 17, wherein the channels include side walls, the rails including rail walls engaging the side walls to prevent rotation of the corresponding contact subassemblies.

19. The multi-port connector system of claim 17, wherein the center conductors extend along contact planes, the rails being received in the corresponding channels such that the contact planes are parallel to one another.

20. The multi-port connector system of claim 17, wherein the rails of the plug contact assemblies are held in the channels of the header housing by an interference fit, and wherein the rails of the receptacle contact assemblies are held in the channels of the receptacle housing by an interference fit.

* * * * *